US006198697B1

(12) United States Patent
Hunziker et al.

(10) Patent No.: US 6,198,697 B1
(45) Date of Patent: Mar. 6, 2001

(54) WATCH CASE FITTED WITH CONTROL MEANS

(75) Inventors: Yannick Hunziker, Delémont; Laurent Kaelin, Sonvilier; André Nussbaum, Bienne, all of (CH)

(73) Assignee: Eta S.A. Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/258,284

(22) Filed: Feb. 26, 1999

(30) Foreign Application Priority Data

Mar. 5, 1998 (CH) ..... 0531/98

(51) Int. Cl.[7] ..... G04C 17/00; G04B 37/00; G04B 29/00

(52) U.S. Cl. ..... 368/69; 262/290; 262/319

(58) Field of Search ..... 368/69, 70, 72–74, 368/262, 263, 288–290, 319–321

(56) References Cited

U.S. PATENT DOCUMENTS 4,307,460 * 12/1981 Polonsky ..... 368/74
4,364,674 * 12/1982 Tesch ..... 368/319
5,252,230 * 10/1993 Kuo ..... 368/263

FOREIGN PATENT DOCUMENTS

672868 * 1/1990 (CH) .
0 694 939 * 1/1996 (EP) .
2278109 * 2/1976 (FR) .
2592186 * 6/1987 (FR) .
2068604 * 12/1981 (GB) .
2205666 * 12/1988 (GB) .

* cited by examiner

*Primary Examiner*—Vit Miska
(74) *Attorney, Agent, or Firm*—Sughrue, Mion, Zinn, Macpeak & Seas, PLLC

(57) ABSTRACT

A watch case (1) including a wall (6) with an outer face and an inner face, which defines a housing intended to accommodate a watch movement (7), and control means (4) able to have at least a first and a second state, which include a moving element (8) mounted so as to slide over the outer face of said wall (6) and able to occupy at least two positions, each position corresponding to one of said states. This watch case is characterised in that said control means (4) further include a push button (9), mounted so as to slide in a hole (6*a*) passing through said wall (6) and provided with an inner end (9*a*) intended to co-operate with said movement (7) and with an outer end (9*b*) co-operating with said moving element (8) and a body in contact with a sealing gasket (10) inserted between said push button (9) and said wall (6).

6 Claims, 3 Drawing Sheets

WATCH CASE FITTED WITH CONTROL MEANS

The present invention concerns a watch case of the type including a wall with an inner face, which defines a housing intended to accommodate a watch movement, and an outer face, and control means able to have at least a first and a second state, which include a moving element mounted so as to slide on the outer face of said wall and able to occupy at least two positions, each position corresponding to one of said states.

Such cases are known. They are used in particular with "alarm" or "repeater" watches which include a sound generating device or a striking mechanism. A watch of this type is disclosed in Swiss Patent No. 672,868. The solution described in this document includes an outer sliding part which slides over the external surface of the case, the outer sliding part being mechanically connected, through an aperture made in the case, to an inner sliding part. A sealing gasket, formed of a leaf made of a soft water resistant material, is arranged between the inner sliding part and the wall of the watch case. Locking means are able to be moved with respect to the outer slide, between a position in which the gasket is compressed and a position in which the gasket is not compressed.

In this case, water resistance is only guaranteed when the locking means have been moved so that the gasket is compressed. In other words, if the user forgets to move these locking means, the water resistance of the watch is not guaranteed.

It is also known that it is difficult to assure the water resistance of a hole which is not of cylindrical shape. This difficulty is increased by the fact that the control and locking movements occur along substantially perpendicular axes.

The solution described in French Patent No. 2 592 186 enables this drawback to be overcome. It consists in symmetrically mounting two mutually opposite push buttons, in two holes which are aligned and pass right through the wall of the middle part. The push buttons are connected to each other by a lever which controls a sound generating device contact. Each of the push buttons is provided with a sealing gasket. The alarm control is effected by pushing one or other of the push buttons.

Such a solution certainly enables improved water resistance to be obtained. However, the fact of having to make two holes in the walls of the case can only increase the risk of leakage.

Moreover, since the holes cannot have radial orientation, the machining thereof is made more difficult.

The main object of the invention is thus to provide a control mechanism as defined hereinbefore, providing a maximum guarantee as regards water resistance, while being of simple and inexpensive design.

The invention thus concerns a watch case including a wall with an inner face, which defines a housing intended to accommodate a watch movement, and an outer face, and control means able to have at least a first and a second state, which include a moving element mounted so as to slide over the outer face of said wall and able to occupy at least two positions, each position corresponding to one of said states, characterised in that said means further include a push button, mounted so as to slide in a hole passing through said wall and provided with an inner end intended to co-operate with said movement and with an outer end co-operating with said moving element.

Other advantages and features of the invention will appear upon reading the following detailed description of an embodiment example given by way of illustrative and non limiting example in conjunction with the annexed drawings, in which.

Figure 1:
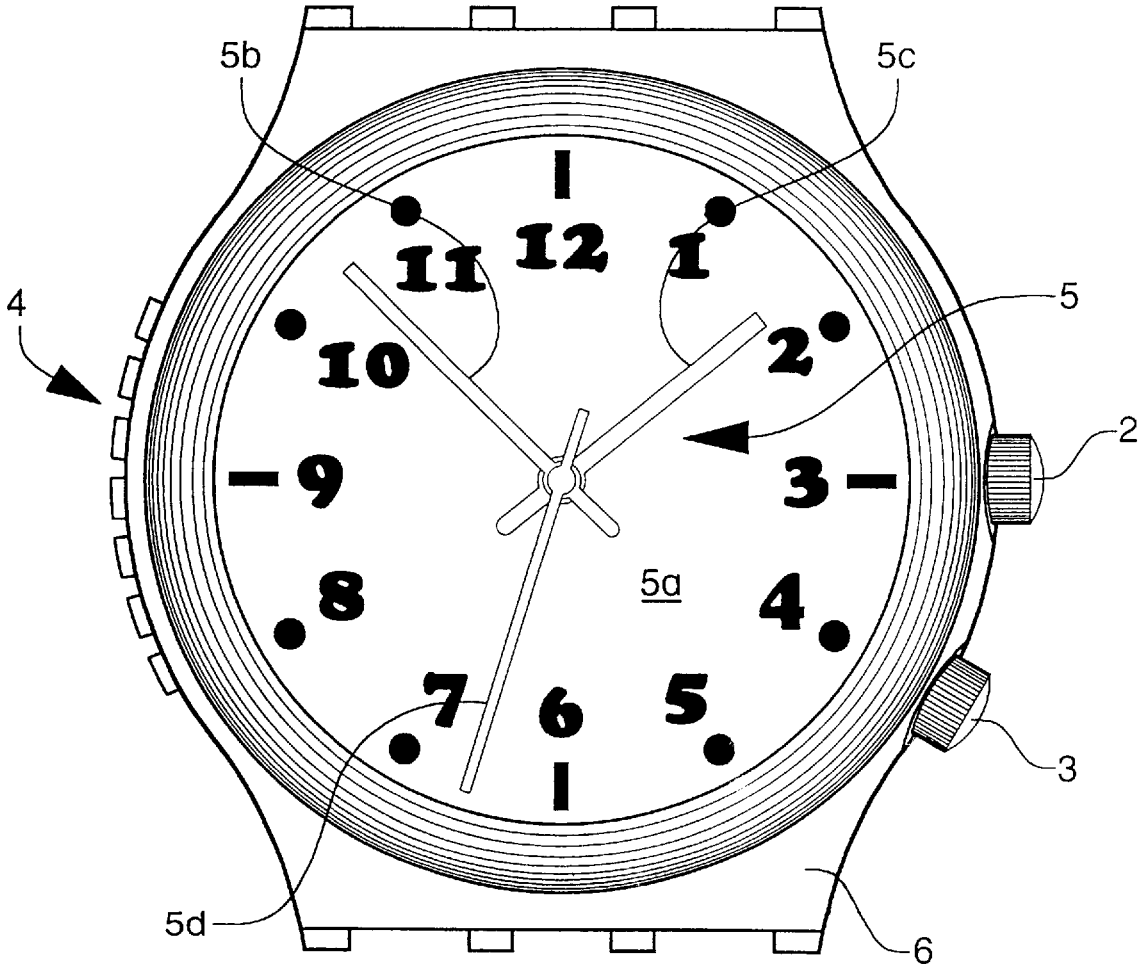
FIG. 1 shows a watch including a case according to the invention.

The watch shown in FIG. 1 has an alarm device in addition to the time display. It includes a case 1, of generally circular shape, two correction stems 2 and 3, control means 4 and display means 5. The latter are formed of a dial 5*a* bearing the hour figures, two time display hands 5*b* and 5*c* and an alarm time display hand 5*d*.

Stem 2, placed at 3 o'clock, allows correction of the position of hands 5*b* and 5*c*. Stem 3, placed at 4 o'clock, allows the position of alarm hand 5*d* to be set. The connections between stems 2 and 3 and the corresponding hands are made by means of conventional time-setting mechanisms, known to those skilled in the art. Consequently, they will not be described.

Control means 4 assure the switching on and off of the alarm device. They will be described in more detail hereinafter.

As can be seen in FIGS. 2 to 5, case 1 includes a lateral wall forming a middle part 6 which defines a housing in which is situated a watch movement 7, shown schematically and partially. This movement 7 carries and drives display hands 5.

Control means 4 includes a moving element 8 as well as a push button 9, both mounted on middle part 6.

Middle part 6 includes a hole 6*a* extending radially through the wall thereof. It is provided with a recess 6*b*, in which moving element 8 is mounted so as to slide. Recess 6*b* is defined by a bottom 6*c* and two lateral walls 6*e*.

Hole 6*a* occupies substantially the central portion of bottom 6*c*. A protuberance 6*f* extends hole 6*a* towards the exterior. Four grooves 6*g*, made in pairs of lateral walls 6*e* and on either side of hole 6*a*, together define a slide-way.

Middle part 6 further includes two depressions 6*h* placed on either side of recess 6*b*. They each include a bottom 6*i* which has a projecting portion 6*k*.

Movement 7 is provided with a spring 7*a* and a contact 7*b*, which co-operates with spring 7*a*, to control the alarm function.

Moving element 8 includes an outer wall 8*a* which fits into the shape of middle part 6. It includes flutes 8*b* which facilitate the manipulation thereof. The two ends of outer wall 8*a* each end in an elastic arm 8*c*, provided with a protuberance 8*d*. Each of the arms is housed in one of depressions 6*h*. Protuberances 8*d* each co-operate with one of projecting portions 6*k*.

Figure 4:
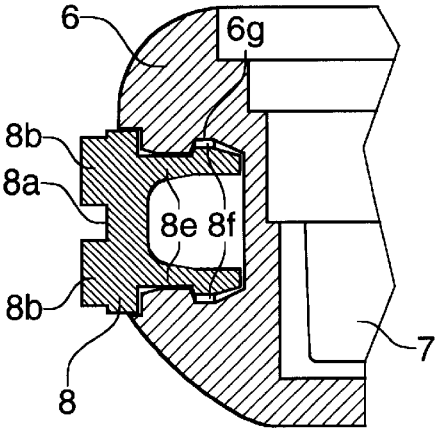

Moving element 8 also includes four legs 8*e*, each provided with a notch 8*f* engaged and secured in one of grooves 6*g* forming a slide-way (see more particularly FIG. 4). Moving element 8 is thus locked onto middle part 6, while keeping its mobility in the direction defined by grooves 6*g*. It thus forms a sliding block.

The space between legs 8*e* has the shape of a cam 8*g* and further includes a finger 8*h*.

Push button 9 is of generally cylindrical shape. It is mounted so as to slide in hole 6*a* which passes through middle part 6. It includes an inner end 9*a*, and an outer end 9*b*. Inner end 9*a* co-operates with spring 7*a*.

Outer end 9*b*, in the form of a rounded head, cooperates with moving element 8, and more particularly cam 8*g*. The body of push button 9 has a groove 9*c*, in which a sealing gasket 10 is positioned.

Finger 8*h* assures the blocking of push button 9, as will be specified hereinafter.

The device which has just been described allows the alarm mechanism of the watch to be controlled. This function is achieved by moving moving element 8 from one to the other of the positions shown respectively in FIGS. 2 and 5.

Figure 2:
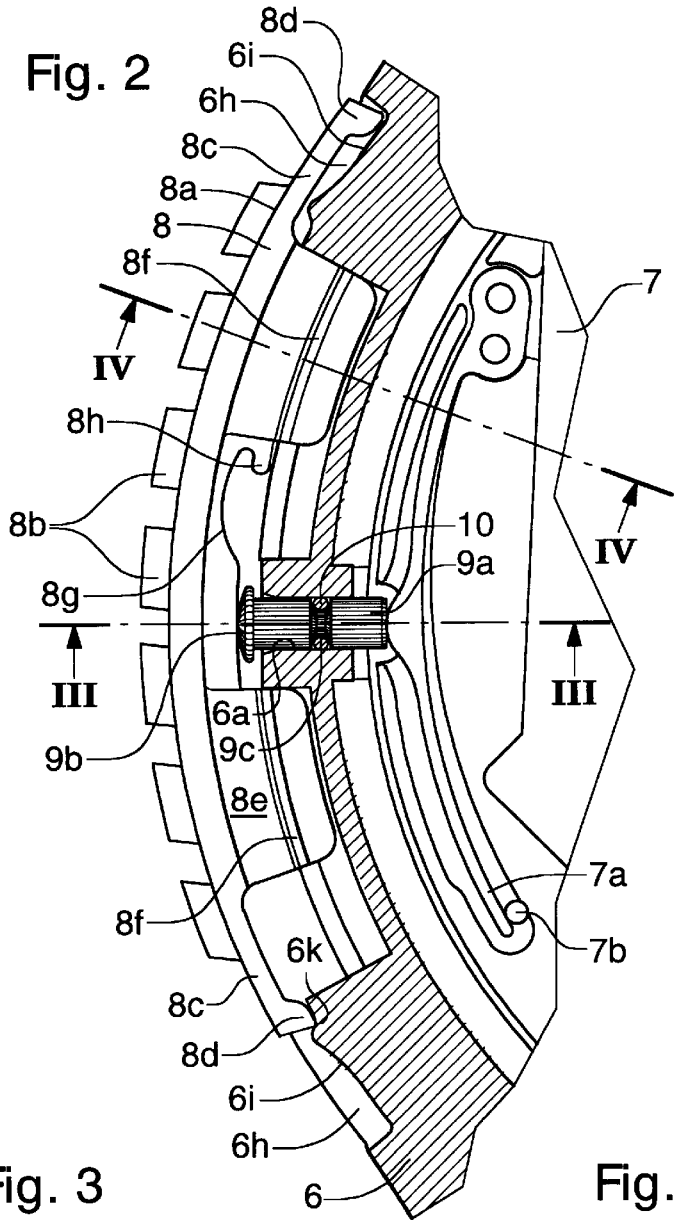
FIG. 2 is a partial enlarged view of the case of FIG. 1, a portion thereof having been cut away to allow the control means, which are in a first position, to appear.
Figure 3:
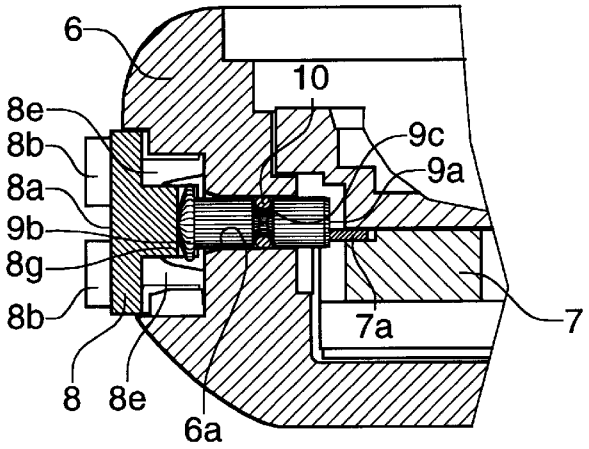
FIGS. 3 and 4 are cross-sections respectively along the lines III—III and IV—IV of FIG. 2.

When moving element 8 is the position shown in FIG. 2, cam 8*g* of element 8 is in a position in which it rests on outer end 9*b* of push button 9. The latter is thus pushed into case 1. Spring 7*a* is bent and touches contact 7*b*, thus controlling the switching on of the alarm device.

Figure 5:
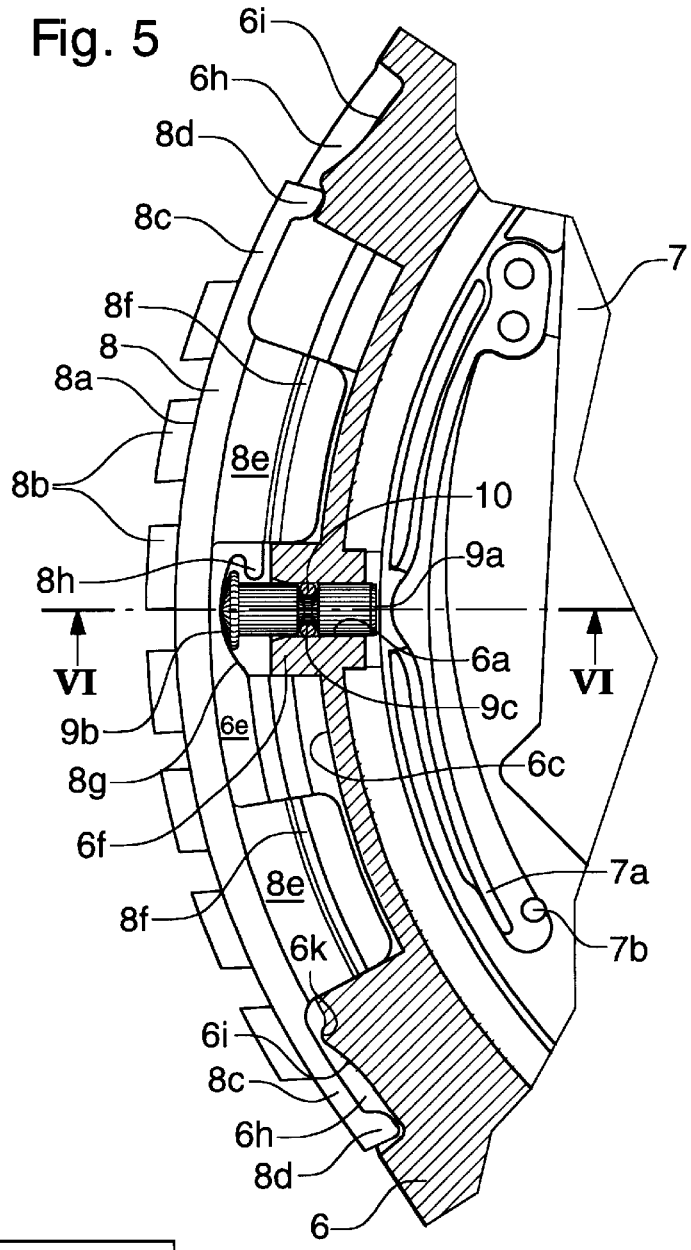
FIG. 5 is a similar view to that of FIG. 2, in which the control means are in a second position.
Figure 6:
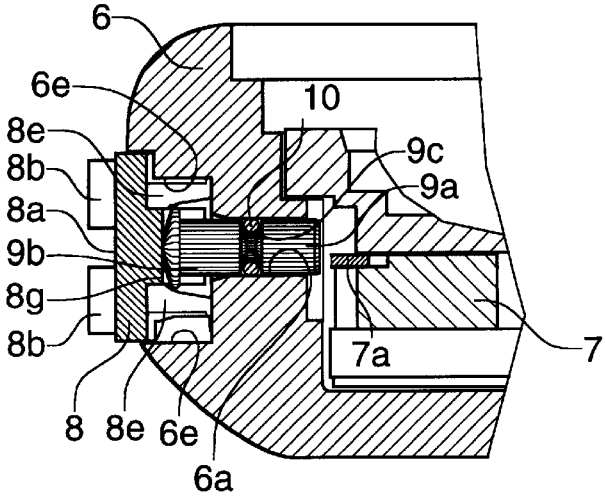
FIG. 6 is a cross-section along the line VI—VI of FIG. 5.

When moving element 8 is the position shown in FIG. 5, cam 8*g* is pulled back. Thus, push button 9, by the effect of spring 7*a*, is biaised outwards. Finger 6*h* is moreover inserted between the head of outer end 9*b* and middle part 6. Push button 9 is thus blocked in the position shown. Consequently, even if the watch underwent a shock, push button 9 could not be pushed in. Finger 6*h* thus acts as locking means. It therefore prevents any inadvertent switching on of the alarm.

The position of moving element 8 is stable both in the position of FIG. 2 and in that of FIG. 5, because of the notches which define elastic arms 8*c* co-operating with projection portions 6*k*.

Passage from one to the other of the two positions occurs by applying a force tangential to the middle part, on flutes 8*b*.

In the device as described, moving element 8 can occupy two stable positions. It is possible to make the same device, but including three stable positions. The structure of cam 8*g*, elastic arms 8*c* and the positions of projection portions 6*k* have simply to be modified.

In the solution described with reference to the drawings, the movement of push button 9 controls an electric contact. It could however be any other mechanism.

The control means as described could also be used to control a device able to take a first stable position and a second drawn position. This is the case in particular of "repeater" mechanisms. A spring, inserted between middle part 6 and moving element 8 would then assure the return of the latter from the drawn position to the stable position.

It is possible to envisage numerous alternatives for assuring the assembly and guiding of moving element 8 on middle part 6, without thereby departing from the scope of the invention.

The watch case described hereinbefore permits the making of a reliable water resistant control device which allows the switching on and off of complementary functions of the watch, in a simple and efficient manner.

What is claimed is:

1. A watch case including a wall with an outer face and an inner face, which defines a housing intended to accommodate a watch movement, and control means able to have at least a first and a second state, which include a moving element mounted so as to slide over the outer face of said wall and able to occupy at least two positions, each position corresponding to one of said states, wherein said control means further include a push button, mounted so as to slide in a hole passing through said wall and provided with an inner end intended to co-operate with said movement and with an outer end co-operating with said moving element and a body in contact with a sealing gasket inserted between said push button and said wall and wherein one of said moving element and said wall includes a projecting portion and the other an elastic arm whose free end co-operates with said projecting portion to define a notch between said two stable positions.

2. A case according to claim 1, wherein said wall defines a middle part in which said hole is made and which carries said sliding element.

3. A case according to claim 2, wherein the hole made in said middle part has radial orientation.

4. A case according to claim 1, wherein said wall includes a slide-way with at least one groove and the moving element forms a sliding block with a body and at least one elastic arm fixed by one end to said body and including a notch at the other end, engaged in the groove.

5. A case according to claim 1, wherein the inner end of the push button co-operates with an elastic element generating a force oriented from the interior to the exterior of the case, wherein the outer end of the push button is rounded and wherein the moving element includes a cam, in contact with the outer end of said push button, holding the latter in a pushed in position when the moving element occupies one of its two positions.

6. A case according to claim 5, wherein the outer end of the push button is provided with a head and the moving element with a finger, both arranged so that in one of the positions of the moving element, the finger is inserted between said head and the wall.

* * * * *